US011091295B2

(12) United States Patent
Lushefski

(10) Patent No.: US 11,091,295 B2
(45) Date of Patent: Aug. 17, 2021

(54) OVOID SHAPED CONTAINER

(71) Applicant: Erin Lushefski, New York, NY (US)

(72) Inventor: Erin Lushefski, New York, NY (US)

( * ) Notice: Subject to any disclaimer, the term of this patent is extended or adjusted under 35 U.S.C. 154(b) by 871 days.

(21) Appl. No.: 15/877,648

(22) Filed: Jan. 23, 2018

(65) Prior Publication Data

US 2018/0206614 A1 Jul. 26, 2018

Related U.S. Application Data

(60) Provisional application No. 62/449,370, filed on Jan. 23, 2017.

(51) Int. Cl.

| | |
|---|---|
| ***B65D 21/08*** | (2006.01) |
| ***A45D 40/24*** | (2006.01) |
| ***A45D 33/18*** | (2006.01) |
| ***A45D 40/00*** | (2006.01) |
| ***A45D 33/24*** | (2006.01) |
| ***B65D 21/02*** | (2006.01) |

(52) U.S. Cl.

CPC ..... *B65D 21/083* (2013.01); *A45D 33/18* (2013.01); *A45D 33/24* (2013.01); *A45D 40/0068* (2013.01); *A45D 40/24* (2013.01); *B65D 21/0228* (2013.01); *A45D 2040/0012* (2013.01); *B65D 21/0209* (2013.01)

(58) Field of Classification Search

CPC .. B65D 21/083; B65D 21/08; B65D 21/0228; B65D 21/0209; B65D 21/02; B65D 21/0233; B65D 69/00; A45C 5/005; A45D 33/18; A45D 33/006; A45D 33/24; A45D 33/00; A45D 40/0068; A45D 40/24; A45D 40/00

USPC .... 220/4.27, 4.26, 8, 23.86, 23.83, DIG. 13; 206/577, 581, 223; 132/314, 294

See application file for complete search history.

(56) References Cited

U.S. PATENT DOCUMENTS

| | | | | |
|---|---|---|---|---|
| 2,909,304 A | | 10/1959 | Powell | |
| 2,998,896 A | | 9/1961 | Miller | |
| 3,441,033 A | * | 4/1969 | Flax | A45D 40/22 132/295 |
| 3,476,123 A | | 11/1969 | Flax | |
| 4,203,525 A | * | 5/1980 | Okubo | A63B 5/12 206/501 |
| 5,209,345 A | | 5/1993 | Haugabook | |

(Continued)

FOREIGN PATENT DOCUMENTS

| | | |
|---|---|---|
| GB | 2010221 A | 6/1979 |
| KR | 200462520 Y1 | 9/2012 |

*Primary Examiner* — Robert J Hicks

(74) *Attorney, Agent, or Firm* — McCarter & English, LLP

(57) ABSTRACT

Described in detail herein include an ovoid or egg-shaped container for housing, storing, and packaging cosmetics and similar items and substances. The bottom of the ovoid shape is slightly flattened in order for the container to stand upright on the surface of which it resides. The container is transversally sliced multiple times yielding separate layers that fasten together in a parallel direction to one another and also detach or unfasten from each other. All layers are configured to accommodate circular metal tin pan trays and/or discs that are removable—but also securable to the inside of cavity of its corresponding layer—or other specific removable parts that pertain to the type of cosmetic for which the space is designated. These pans and specific parts will house cosmetic substances.

20 Claims, 7 Drawing Sheets

(56) References Cited

U.S. PATENT DOCUMENTS

| | | | | |
|---|---|---|---|---|
| 5,287,979 | A | 2/1994 | Bourgeois | |
| 5,671,856 | A * | 9/1997 | Lisch | A01K 97/06 206/519 |
| 6,286,666 | B1 | 9/2001 | Umdasch | |
| 8,444,337 | B2 * | 5/2013 | Teller | A61K 8/922 401/88 |
| 2004/0129600 | A1 | 7/2004 | Gueret | |
| 2006/0186075 | A1 | 8/2006 | Rainey et al. | |
| 2007/0017915 | A1 | 1/2007 | Weder et al. | |
| 2007/0108092 | A1 | 5/2007 | Minuto et al. | |
| 2009/0308408 | A1 | 12/2009 | Winckels et al. | |
| 2010/0200438 | A1 * | 8/2010 | Davies | B65D 71/502 206/223 |
| 2011/0204049 | A1 | 8/2011 | Weder et al. | |
| 2014/0299151 | A1 | 10/2014 | Stroud | |

* cited by examiner

OVOID SHAPED CONTAINER

CROSS-REFERENCE TO RELATED PATENT APPLICATIONS

This application claims priority to U.S. Provisional Application No. 62/449,370 filed on Jan. 23, 2017, the content of which is hereby incorporated by reference in its entirety.

BACKGROUND

There is a need for an improved modular container that is physically appealing that can also accommodate storage of transferred cosmetics of various types and function as a consolidated transportable container and maximize the volume of cosmetic substance that it can hold. Furthermore, a seamless removal of pans from an inside of a container can be desirable.

SUMMARY

The present disclosure is directed to an ovoid or egg-shaped container for housing, storing, and packaging cosmetics and similar items and substances. The bottom of the ovoid shape is slightly flattened in order for the container to stand upright on the surface of which it resides. The container is transversally sliced multiple times yielding separate layers that fasten together and are positioned parallel to one another and also detach or unfasten from each other. All layers are configured to accommodate circular metal tin pan trays and/or discs that are removable—but also securable to the inside of cavity of its corresponding layer—or other specific removable parts that pertain to the type of cosmetic for which the space is designated. These pans and specific parts will house cosmetic substances.

Exemplary embodiments include a container including a top layer including a rounded top surface, a circular flat bottom surface, an interior cavity. The interior cavity is enclosed by a circular wall and attachment mechanisms are disposed on the interior of the circular wall. The container further includes a plurality of intermediary layers, each intermediary layer including a circular top surface and a circular bottom surface. The circular top surface includes a circular wall extending from the circular top surface creating a volume with an open face, and the bottom surface includes a circular interior cavity and the outside of the circular wall and the interior of the circular interior cavity include attachment mechanisms. The container further including a bottom layer including a top surface and a bottom surface. The top surface includes a circular wall extending from the top surface creating a volume with an open face, the outside of the circular wall of the bottom layer includes attachment mechanisms, and the bottom surface includes a flat base. The top layer and the bottom layer are each secured to at least one intermediary layer using the attachment mechanisms to form an ovoid shaped container.

In one embodiment, a container assembly includes a top layer including a rounded top surface, a circular flat bottom surface, an interior cavity. The interior cavity is enclosed by a circular wall and attachment mechanisms are disposed on the interior of the circular wall. The container further includes a plurality of intermediary layers, each intermediary layer including a circular top surface and a circular bottom surface. The circular top surface includes a circular wall extending from the circular top surface creating a volume with an open face, and the bottom surface includes a circular interior cavity and the outside of the circular wall and the interior of the circular interior cavity include attachment mechanisms. The container further including a bottom layer including a top surface and a bottom surface. The top surface includes a circular wall extending from the top surface creating a volume with an open face, the outside of the circular wall of the bottom layer includes attachment mechanisms, and the bottom surface includes a flat base. The top layer and the bottom layer are each secured to at least one intermediary layer using the attachment mechanisms to form an ovoid shaped container. In an assembled state, the attachment mechanisms disposed on the outside of a circular wall of a first intermediary layer of the plurality of the intermediary layers are configured to be attached to the attachment mechanisms disposed on the interior of the circular wall of the top layer. The attachment mechanisms disposed on the outside of a circular wall of a second intermediary layer of the plurality of intermediary layers are configured to be attached to the attachment mechanisms disposed in the interior of the circular interior cavity of the circular bottom surface of the first intermediary layer. The attachment mechanisms disposed on the outside of a circular wall of a third intermediary layer of the plurality of intermediary layers are configured to be attached to the attachment mechanisms disposed in the circular interior cavity of the circular bottom surface of the second intermediary layer, the attachment mechanisms disposed on the outside of a circular wall of bottom layer are configured to be attached to the attachment mechanisms disposed in the circular interior cavity of the bottom surface of the third intermediary layer.

In one embodiment, a container includes a top layer including a rounded top surface, a circular flat bottom surface, an interior cavity. The interior cavity is enclosed by a circular wall and attachment mechanisms are disposed on the interior of the circular wall. The container further includes a plurality of intermediary layers, each intermediary layer including a circular top surface and a circular bottom surface. The circular top surface includes a circular wall extending from the circular top surface creating a volume with an open face, and the bottom surface includes a circular interior cavity and the outside of the circular wall and the interior of the circular interior cavity include attachment mechanisms. The container further including a bottom layer including a top surface and a bottom surface. The top surface includes a circular wall extending from the top surface creating a volume with an open face, the outside of the circular wall of the bottom layer includes attachment mechanisms, and the bottom surface includes a flat base. The container further includes a circular receptacle configured to store and support liquid or solid objects. The circular receptacle is disposed within the volume of an intermediary layer and secured in the groove(s) of a circular wall of the intermediary layer disposed directly below the top layer. The container further includes a plurality of circular discs configured to store and support liquid or solid objects. Each of the circular discs are disposed within the volume of at least one of the intermediary layers and are secured in the groove(s) of a circular wall of the at least one of the intermediary layers. Each of the plurality of circular discs include an outside surface and an interior volume. Wings extend from the outside surface and are configured to rest in the groove(s) of the circular wall of the at least one of the intermediary layers. The container further includes a circular tray configured to store and support liquid or solid objects. The circular tray is disposed within the volume of the bottom layer and secured in the groove(s) of the circular wall of the bottom layer. The tray includes an outside surface and an interior volume, wings extend from the outside surface and are configured to rest in the groove(s) of the circular wall of the bottom layer.

BRIEF DESCRIPTION OF DRAWINGS

Some embodiments are illustrated by way of example in the accompanying drawings and should not be considered as a limitation of the invention.

DESCRIPTION OF EXEMPLARY EMBODIMENTS

Described in detail herein include an ovoid or egg-shaped container for housing, storing, and packaging cosmetics and similar items and substances. The bottom of the ovoid shape is slightly flattened in order for the container to stand upright on the surface of which it resides. The container is transversally sliced multiple times yielding separate layers that fasten together in a parallel direction to one another and also detach or unfasten from each other. All layers are configured to accommodate circular metal tin pan trays and/or discs that are removable—but also securable to the inside of cavity of its corresponding layer—or other specific removable parts that pertain to the type of cosmetic for which the space is designated. These pans and specific parts will house cosmetic substances. It can be appreciated the container can be of different shapes.

Figure 1:
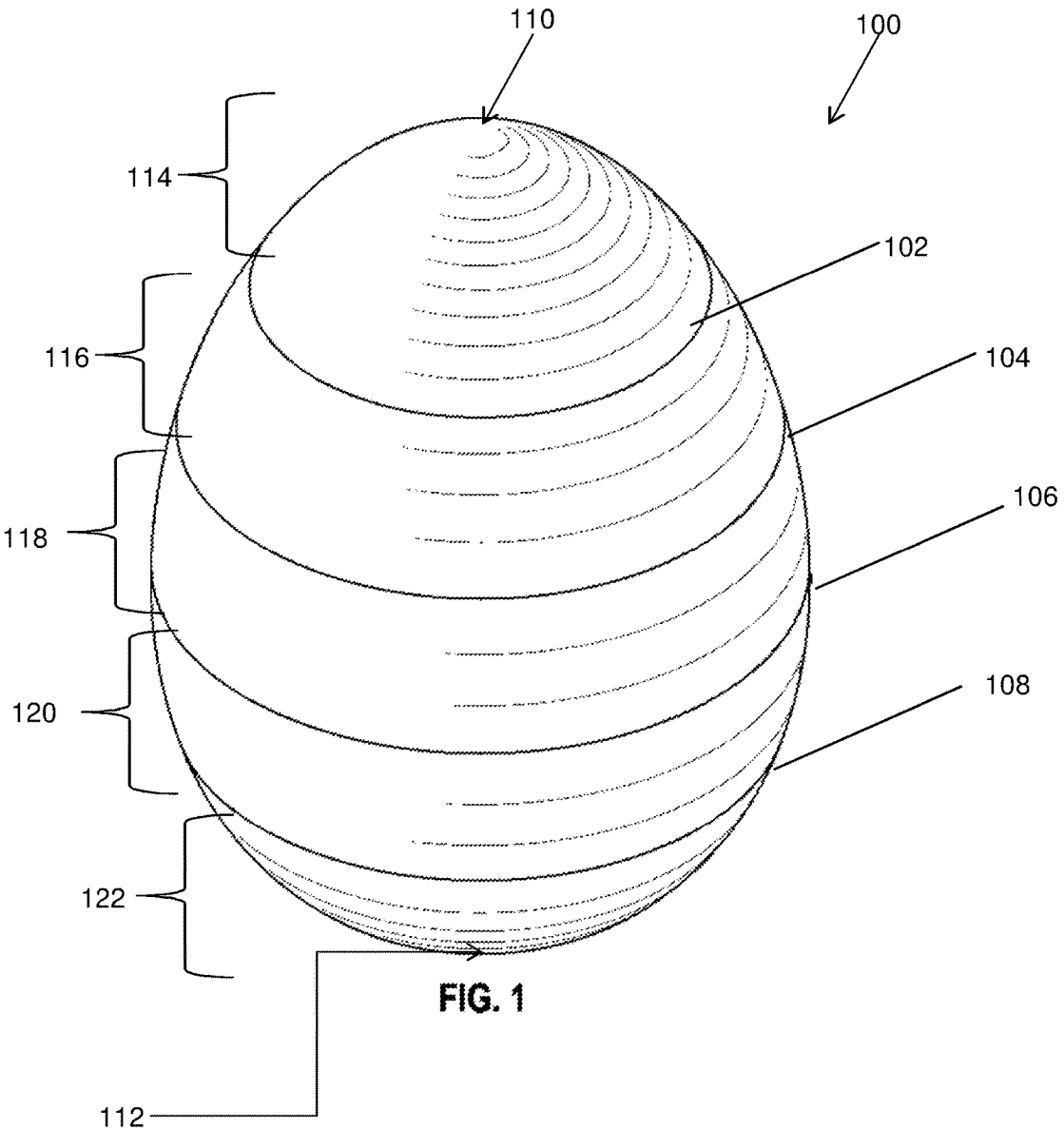
FIG. 1 is a perspective view of a container, according to example embodiments.

FIG. 1 is a perspective view of the ovoid shaped container in accordance with the an exemplary embodiment. The container 100 can be formed by multiple different layers 114-122 attached/fastened/removably secured to one another. The container 100 can be of an ovoid shape. The container 100 can include a top layer 114, multiple intermediary layers 116-120 and a bottom layer 122. The top layer 114 can have a rounded top surface 110. The bottom layer 122 can have a bottom surface 112 including a flat surface at the bottom, configured to keep the support the container 100 and maintain an upright position. In a closed position the container 100 all of the layers 114-122 can be attached/fastened/secured to one another. In open position some or all of the layers 114-122 are detached/fastened/unsecured from one another.

Each layer in the container 100 can be circumferentially attached/fastened/removably secured to another layer forming an edge on the outside surface of the ovoid-shaped container. For example, the top layer 114 can be attached/fastened/removably secured to a first intermediary layer 116 at edge 102. The first intermediary layer 116 can be attached/fastened/removably secured to a second intermediary layer 118 at edge 104. The second intermediary layer 118 can be attached/fastened/removably secured to a third intermediary layer 120 at edge 106. The third intermediary layer 120 can be attached/fastened/removably secured to a bottom layer 122 at edge 108.

The layers 114-122 can be stacked on top of each other. The layers 114-122 can be attached and/or fasten to each other, via an attachment mechanism. When the layers 114-122 are attached and/or fastened to one another, each layer of the container 100 can be in a closed position. When a layer is detached from another layer the detached layer can be in an open position. All or individual layers 114-122 can be detached and/or unfastened from one another. In a closed position the container 100 can be a stacked modular container. The circumference of the container 100 can increase towards the middle and decrease towards the top and the bottom. For example, the circumference of the layers disposed in the middle can be larger than the layers disposed at the bottom and the top. Each layer can be individually detached from the attached layer by twisting the layer circumferentially in a clockwise and/or counter-clockwise direction. Alternatively, the layers 114-122 detach from the attached layer by sliding the layer in a lateral direction along the X-axis and/or pulling the layer along the Y axis.

Figure 2:
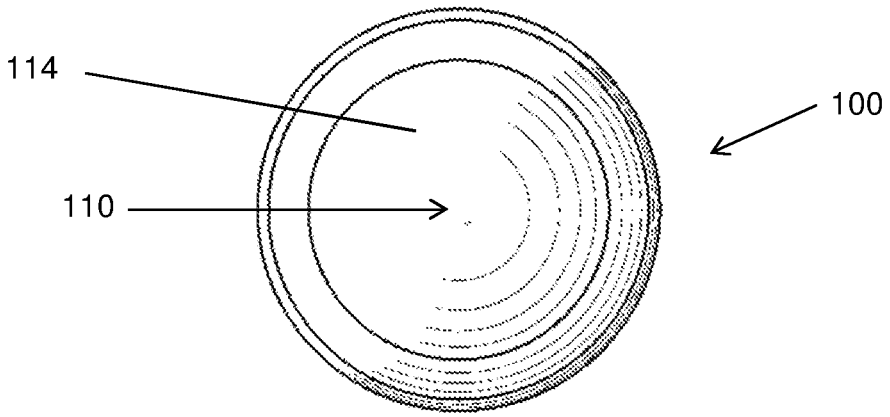
FIG. 2 illustrates is a top view of the container in accordance with an exemplary embodiment.
Figure 3:
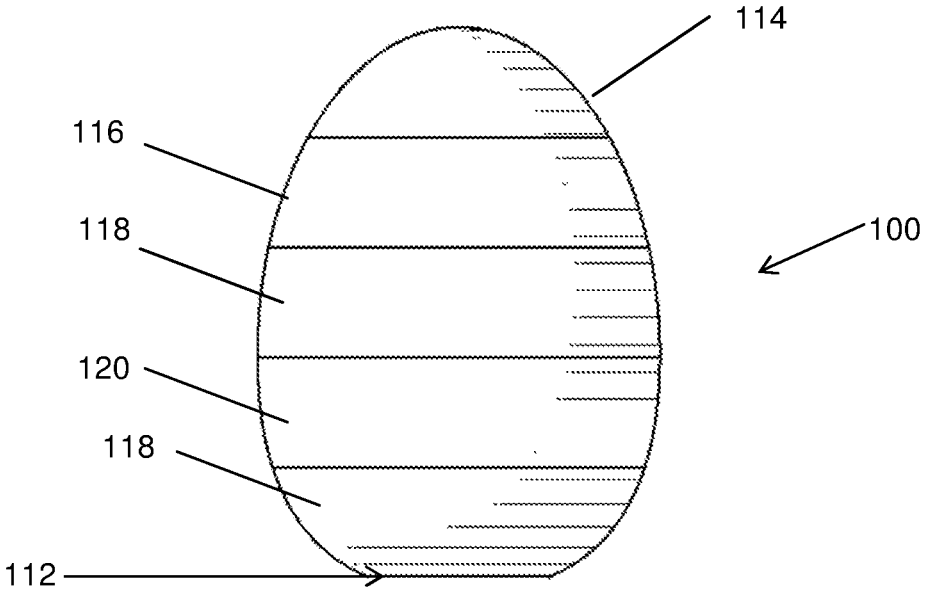
FIG. 3 is a side view of the container in accordance with an exemplary embodiment.
Figure 4:
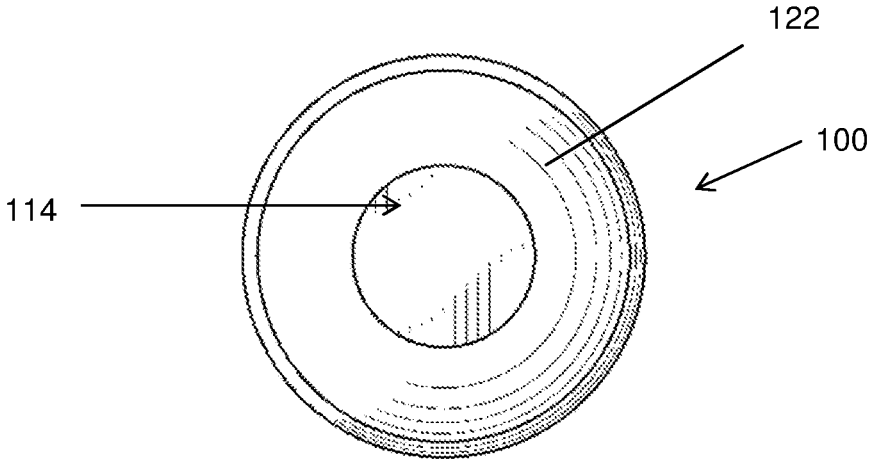
FIG. 4 is a bottom view of the container in accordance with an exemplary embodiment.

FIGS. 2-4 illustrate a top, side, and bottom view of the ovoid shaped container according to exemplary embodiments. With reference to FIG. 2, the top most layer 114 of the container 100 can form a rounded shaped top 110, creating a concave shape. With reference to FIG. 3, the container 100 can maintain the same shape in a front, left side, right side and rear view. As described above, the container 100 can include multiple different layers 114-122. It can be appreciated the container 100 can include any number of intermediary layers. With reference to FIG. 4, the bottom layer 122 of the container 100 can include a bottom surface 112. The bottom surface 112 include a flat portion. The flat portion can be configured to support the container 100 and maintain the container 100 in an upright position.

Figure 5:
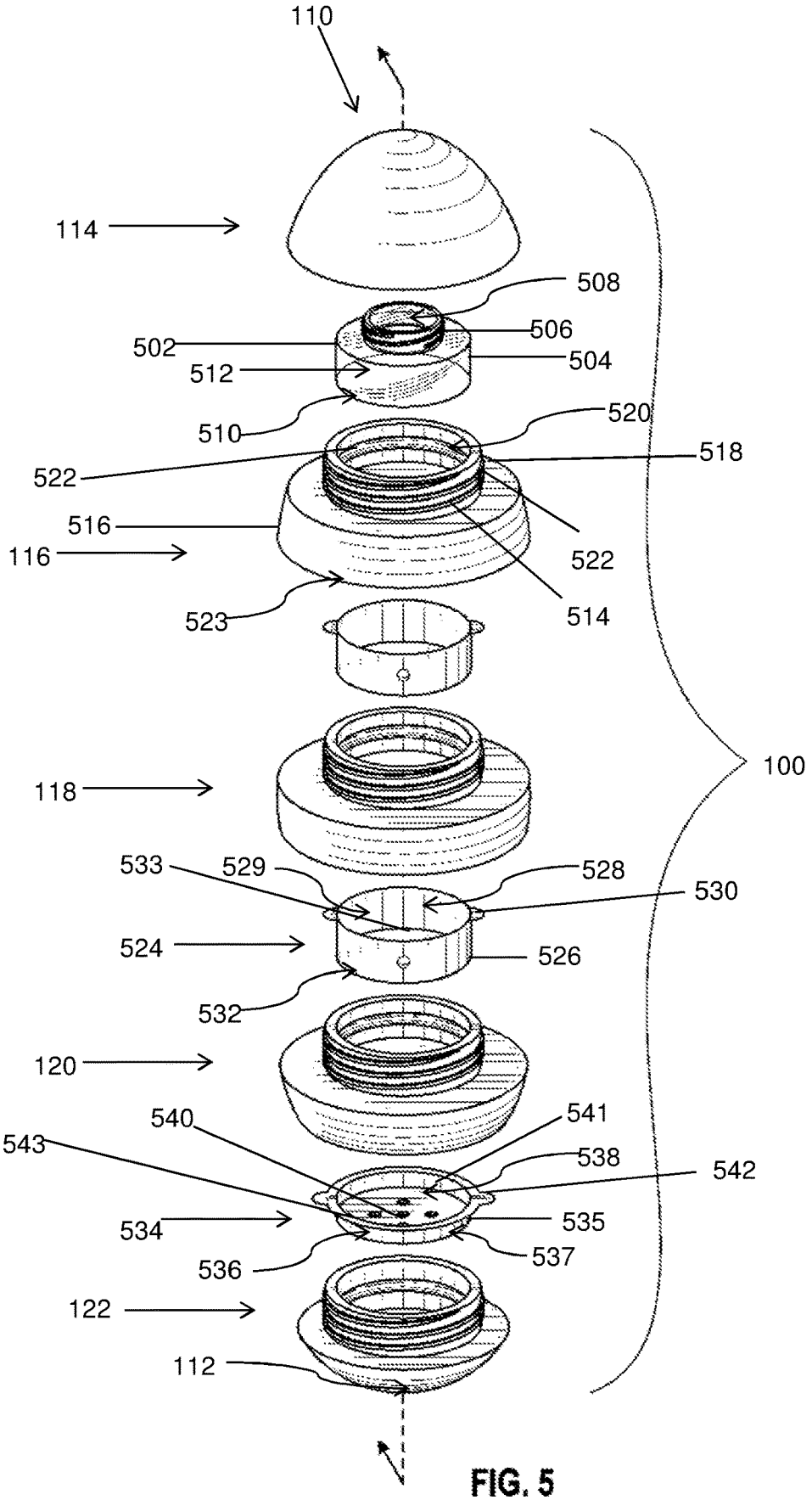
FIG. 5 is an exploded interior view of the container in accordance with an exemplary embodiment.
Figure 6:
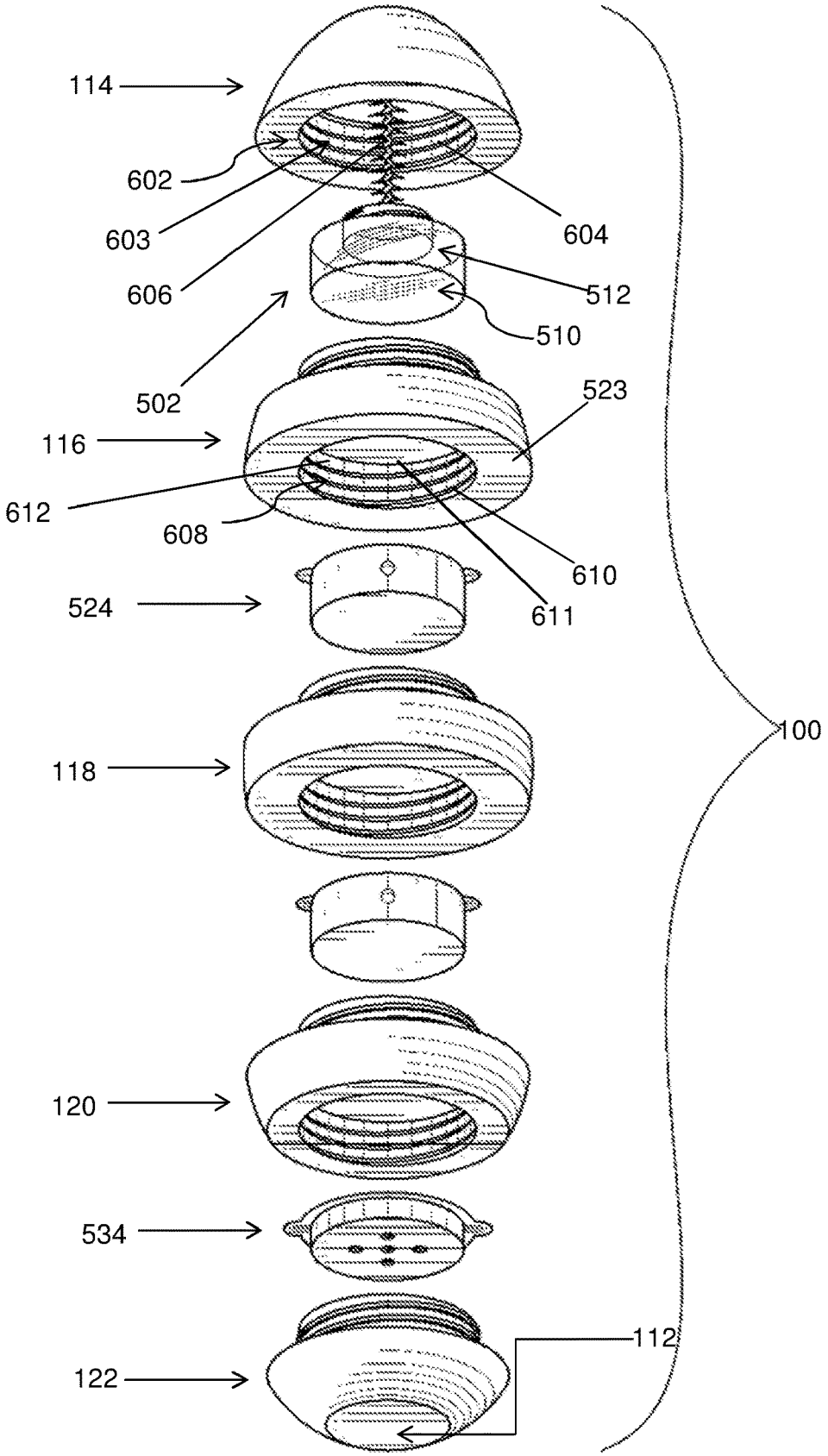
FIG. 6 is an exploded interior view of the container in accordance with an exemplary embodiment.
Figure 7:
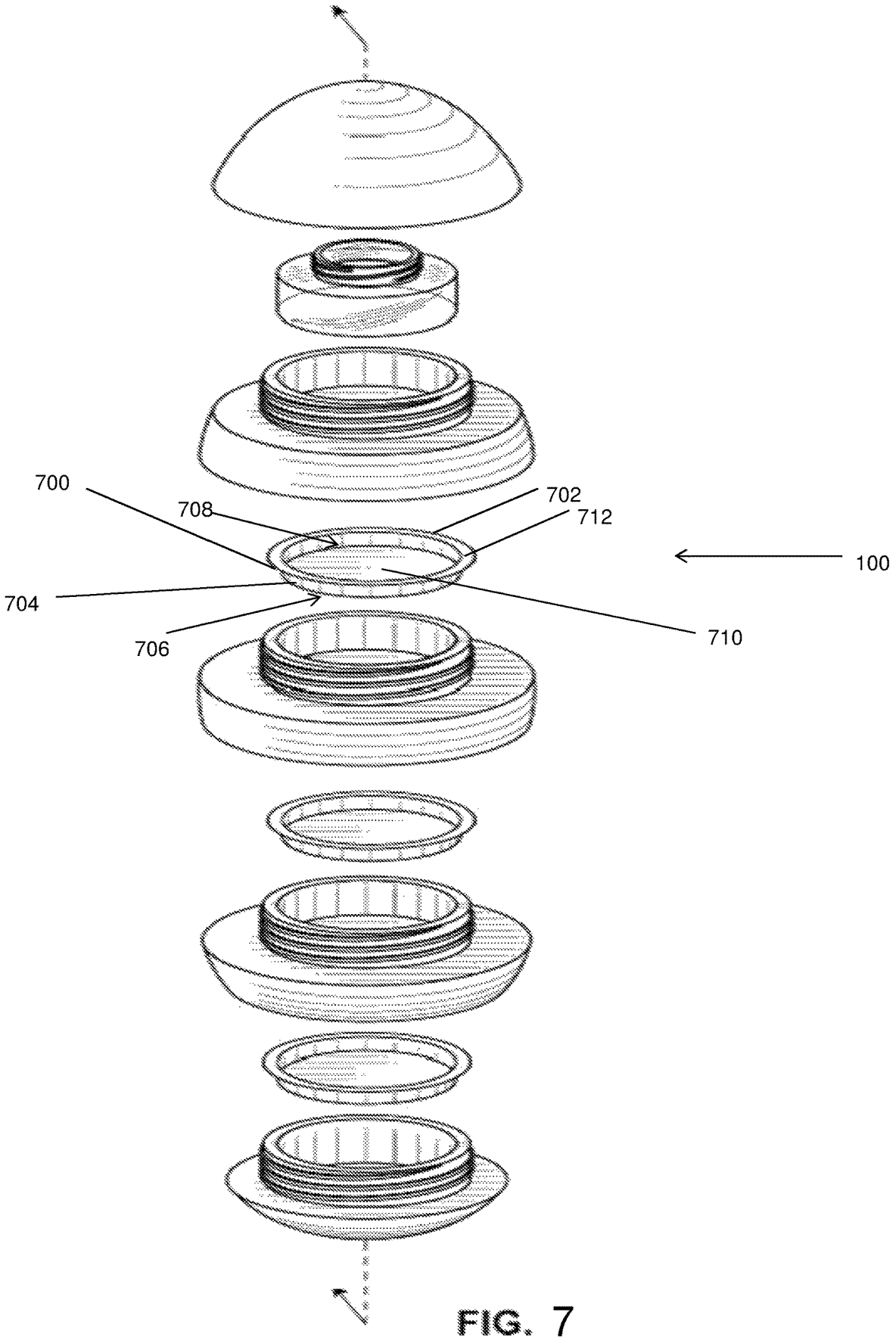
FIG. 7 is an exploded interior view of the container in accordance with an exemplary embodiment.

FIGS. 5-7 are an interior views of the ovoid-shaped cosmetic container 100 according to example embodiments. As mentioned above, the ovoid-shaped cosmetic container can include multiple detachable layers. With reference to FIG. 5, each of the layers 114, 116 and 122 of the container 100 can be detached/uncoupled/unfastened from one another. The interior of the container 100 can include a receptacle 502, intermediary layers 116-120, discs 524, and a tray 534. As mentioned above, the top layer 114 can include a rounded top surface 110. The bottom layer 122 can include a flat bottom surface 112.

The receptacle 502 can include an outer surface 504, an opening 508, attachment mechanisms 506, a bottom surface 510 and an interior volume 512. The receptacle 502 can be disposed below the top layer 114. The interior volume 512 can be accessed to through the opening 508. The attachment mechanisms 506 such as threads can be disposed around the outside of the opening 508. The receptacle 502 can be configured to house and store liquid or solid products. As a non-limiting example, the receptacle 502 can be configured to house and store products such as nail polish or liquid mascara accessible through the opening 508.

Each of the intermediary layers 116-120 and the bottom layer 122 can include a top surface 518, an outer surface 516, and a circular wall 514 extending from the top surface 518. Attachment mechanisms 515 can be disposed around the outside of the circular wall 514. As an example, the attachment mechanisms 515 can be threads. The circular wall 514 can form an interior volume 520. The circular wall 514 can include groove(s) on around the inside of the circular wall 514. Each of the intermediary layers 116-120 can include a bottom surface 523. The bottom layer 122 can include a bottom surface 112. The intermediary layers 116-120 can be a circular shape.

Each disc 524 can include an outside surface 526, an top opening 528, an interior volume 529, wings 530, an flat bottom surface 532 and a support surface 533. The wings 530 can extend from the outside surface 526. In one example, the wings 530 can be shaped in a semi-circle or triangle. The wings 530 can be disposed around the outside surface 526 of the disc 524. The support surface 533 can be in the interior volume 529 configured to support liquid or solid products deposited in the interior volume 529 of the disc 524. The outside surface 526 can be a circular shape. The interior volume 529 can be configured to store, house and support solid and/or liquid items. As a non-limiting example, the discs 524 can house and support cosmetic products such as foundation, rouge, blush, face powder, concealer, lip balm, primer, bronzer, and other cosmetic products.

The tray 534 can include a top surface 535, an outside surface 536, a bottom surface 537, an interior volume 538, a support surface 541, apertures 540 disposed on the support surface 541, a lip 543, and wings 542. The top surface 535 can include the lip 543 of the tray 534, which extends outward from the tray 534. The lip 543 can extend farther outward than the circumference of the outside surface 536. than the outside surface 536. The wings 542 can extend from the lip 543 and can be disposed around the tray 524. The support surface 541 can be in the interior volume 538 of the tray 534. The apertures 540 can be disposed on the support surface 541. The support surface 541 can be configured to support excess debris which the interior volume 538 of the tray received from the products or objects stored in the receptacle 502 and/or discs 524. The outside surface 536 can be circular.

As mentioned above, the receptacle 502 can be disposed below the top layer 114. The receptacle can be removably secured in the interior volume 520 of the intermediary layer 116 below the top layer 114. The bottom surface 510 of the receptacle 502 can rest on the groove(s) 522 disposed on the inside of the circular wall 514 of the intermediary layer 116. The groove(s) 522 can support and secure the receptacle 502. The receptacle 502 can be configured to be smaller in circumference than the interior volume 520 of the intermediary layer 116. The attachment mechanism of the receptacle 502 can be fastened to the interior of the top layer 114. The interior of the top layer 114 will be described with reference to FIG. 6. While the container 100 is an open position (i.e. the layers are detached/unfastened to one another), the receptacle 502 can be removed from the interior volume 520 of the intermediary layer 116. While the container 100 is a closed position (i.e. the layers are attached/fastened to one another) the receptacle 502 cannot be removed/accessed from the from the interior volume 520 of the intermediary layer 116.

Each of the discs 524 can be removably secured in the interior volume 520 of an intermediary layers 118-120. The wings 530 of the discs 524 can rest on the groove(s) 522 disposed on the inside of the circular wall 514 of the intermediary layer 116. The groove(s) 522 can support and secure the discs 524. The discs 524 can be configured to be smaller in circumference than the interior volume 520 of the intermediary layer 118-120. While the container 100 is an open position (i.e. the layers are detached/unfastened to one another), the discs 524 can be removed from the interior volume 520 of the intermediary layer 118-120. While the container 100 is a closed position (i.e. the layers are attached/fastened to one another) the discs 524 cannot be removed/accessed from the from the interior volume 520 of the intermediary layer 118-120. A space may remain between the discs 524 and the bottom surface of the interior volume 520 of the of the intermediary layer 118-120, when the disc is disposed in the interior volume 520.

The tray 534 can be removably secured in the interior volume 520 of the bottom layer 122. The wings 542 of the tray 534 can rest on the groove(s) 522 disposed on the inside of the circular wall 514 of the bottom layer 122. The groove(s) 522 can support and secure the tray 534. The tray 534 can be configured to be smaller in circumference than the interior volume 520 of the bottom layer 122. While the container 100 is an open position (i.e. the layers are detached/unfastened to one another), the tray 534 can be removed from the interior volume 520 of the bottom layer 122. While the container 100 is a closed position (i.e. the layers are attached/fastened to one another) the tray 534 cannot be removed/accessed from the from the interior volume 520 of the bottom layer 122. A space may remain between The tray 534 and the bottom surface of the interior volume 520 of the of the bottom layer 122, when the circular disc is disposed in the interior volume 520. In one example, the tray 534 house and support liquid or physical objects. In another example, the tray 534 can be configured to collect debris from liquid or physical objects housed and/or stored in the receptacle 502 and/or discs 524. The debris can fall through the apertures into a space between the tray 524 and the volume 520 of the bottom layer 122.

It can be appreciated that various layers of the container 100 can be selectively removed. It can also be appreciated the attachment mechanisms on the receptacle 502 intermediary layer 116 or bottom layer 122 can be one or more of, threads, magnetic attachment devices, Velcro attachment device, adhesive attachment devices and various other attachment devices configured to attached/fasten the layers to one another.

With reference to FIG. 6, the top layer 114 can include a bottom surface 602. The bottom surface 602 can include an interior cavity 603. Attachment mechanisms 604 can be disposed around the circumference of the interior cavity 603. The attachment mechanisms (e.g. attachment mechanisms 515 as shown in FIG. 5) of the intermediary layer 116 can attach/fasten with the attachment mechanisms 604 of the top layer 114. As an example, the attachment mechanisms of the intermediary layer 116 and the attachment mechanisms 604 of the top layer 114 can be treaded. The attachment mechanisms of the intermediary layer 116 and the attachment mechanisms 604 of the top layer 114 can attach/fasten by coupling intermediary layer 116 and the top layer 114 and twisting the intermediary layer 116 and/or the top layer 114 a clockwise direction. The attachment mechanisms of the intermediary layer 116 and the attachment mechanisms 604 of the top layer 114 can detach/unfasten by twisting the intermediary layer 116 and/or the top layer 114 a counter-clockwise direction.

While the container 100 is in a closed position, the opening (e.g. opening 508 as shown in FIG. 5) of the receptacle 508 can be inserted in the interior cavity 603 of the top layer 114. In one embodiment, an application instrument 606 (e.g. a mascara applicator, lipstick, eye shadow brush or any other type of application instrument) can extend from the interior cavity 603 of the top layer 114. While the container 100 is in a closed position, the application instrument 606 can be disposed inside the receptacle 502 through the opening of the receptacle. As an example, the volume 512 of the receptacle 502 can house/store an application product (i.e. mascara). While in the container 100 is an open position the application instrument 606 can be manually inserted and removed from the volume 512 of the receptacle 502 through the opening of the receptacle 502, while remaining attached to the interior cavity 603 of the top layer 114.

Each of the intermediary layers 116-120 can include a bottom surface 523. The bottom surface can include a cavity 608. The cavity 608 can be a circular shape. The cavity 608 can include attachment mechanisms 610 disposed around a side interior wall 612 and a top wall 611. The attachment mechanisms (e.g. attachment mechanisms 515 as shown in FIG. 5) disposed on the top surface (e.g. top surface 518 as shown in FIG. 5) of the intermediary layers 116-120 and/or bottom layer 122 can attach/fasten with attachment mechanisms 610 disposed around a side interior wall 612 of the cavity 608 of different intermediary layer. As an example, the attachment mechanisms disposed on the top surface of an intermediary layer 118 and the attachment mechanisms 610 disposed around a side interior wall 612 of the cavity 608 of the intermediary layer 116 can be treaded. The attachment mechanisms disposed on the top surface of an intermediary layer 118 and the attachment mechanisms 610 disposed around a side interior wall 612 of the cavity 608 of the intermediary layer 116 can attach/fasten by coupling intermediary layer 116 and intermediary layer 118 and twisting the intermediary layer 116 and/or the intermediary layer 118 a clockwise direction. The attachment mechanisms disposed on the top surface of an intermediary layer 118 and the attachment mechanisms 610 disposed around a side interior wall 612 of the cavity 608 of the intermediary layer 116 can detach/unfasten twisting the intermediary layer 116 and/or the intermediary layer 118 a counter-clockwise direction. While in a closed position the discs 524 and/or tray 524 can be covered by the top wall 611 of the cavity 608 of the intermediary layers 116-120.

With reference to FIG. 7, in one embodiment, the discs and trays (discs and trays 524, 534 as shown in FIG. 5) can be replaced by pans 700. The pans 700 can include a top surface 702, an outside surface 704, a bottom surface 706, an interior volume 708, and a support surface 710. The top surface 702 can include the lip 712 of the pan 700, which extends outward from the pan 700. The lip 712 can extend farther outward than the circumference of the outside surface 704 of the pan 700. The support surface 710 can be in the interior volume 708 of the pan 700. The support surface 712 can be configured to support/house/store liquid or solid objects. The outside surface 708 can be circular.

Figure 8:
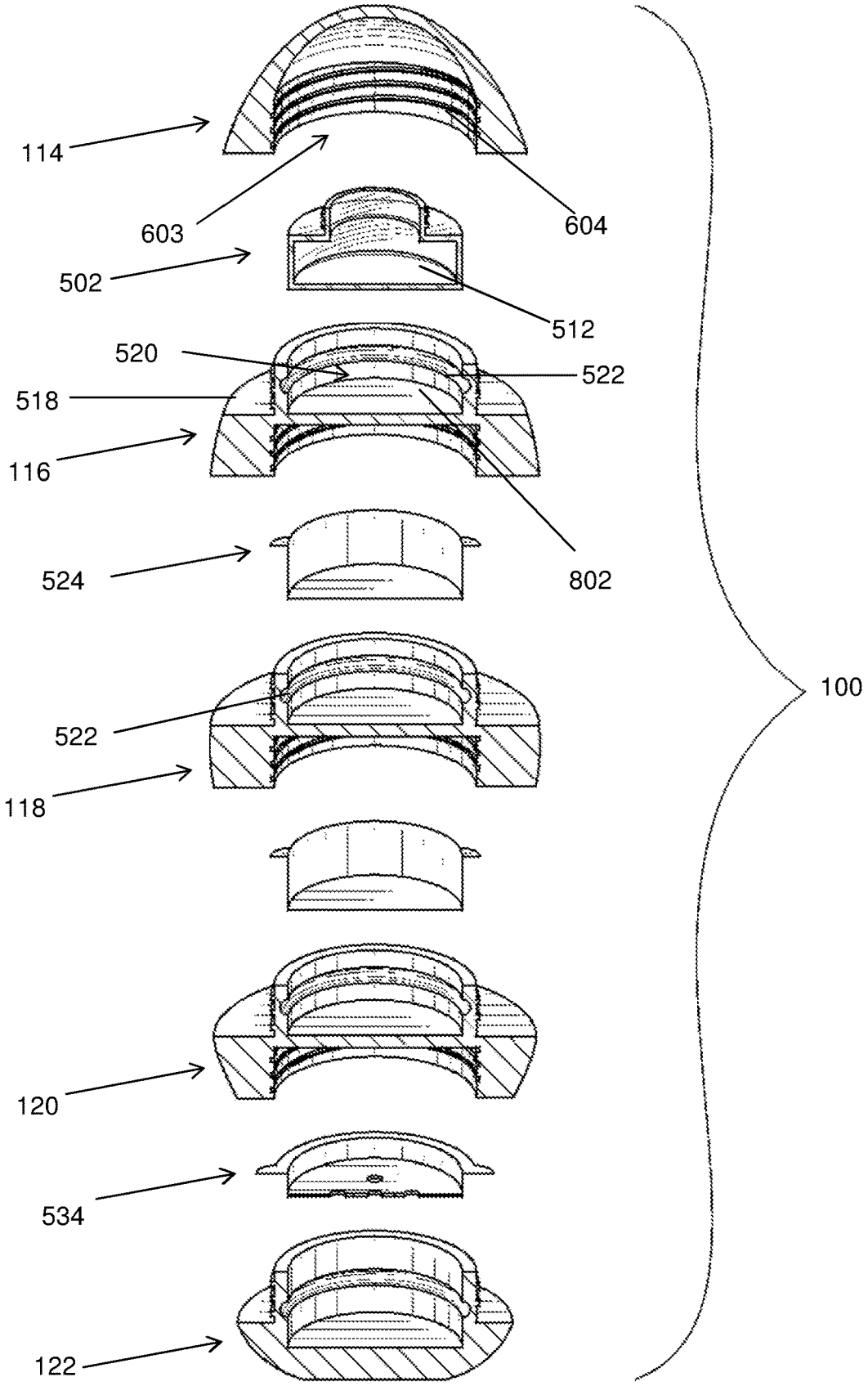
FIG. 8 is an interior view of the container in accordance with an exemplary embodiment.

FIG. 8 is an interior view of the container according to example embodiments. As described above, the container 100 can include a top layer 114, intermediary layers 116-120 and a bottom layer 122. The top layer 114 can include an interior cavity 603. Attachment mechanisms 604 can be disposed around the interior cavity 603.

The receptacle 502 configured to house/store liquid of solid objects in the volume 512, can be disposed beneath the top layer 114. The receptacle 502 can rest on the groove(s) 522 of the inside of the circular wall 514 of the intermediary layer 116. The discs 524 can rest on the groove(s) 522 of the inside of the circular wall 514 of the intermediary layers 118-120. The tray 534 can rest on the groove(s) 522 of the inside of the circular wall 514 of the bottom layer 122. The interior cavity 520 of the intermediary layers 116-120 and/or bottom layer 122, can include a supporting surface 802, below the groove(s) 522. The bottom surfaces of the receptacle 502, discs 524, and tray 534 can be disposed above the supporting surface 802, while resting on the groove(s) 522.

In a non-limiting example, in a closed position the container 100 can be 2 and ⅜ inches in height and 1 and ⅞ inches in width. Each intermediary layer and the bottom layer can be ⅜ inches. The top layer 114 and the intermediary layer 116 beneath the top layer can be ⅞ inches in height. The circular walls on disposed in the intermediary layers 116-120 and the bottom layer 122 can be 5/16 inches in height. The width edges of the circular walls can incrementally increase from the top to the bottom, starting at 1/16 of an inch, incrementing to 3/32 of an inch, incrementing further to ⅛ of an inch and finally incrementing to 5/32 of an inch of the edges of the protruding circular wall on the bottom layer. The diameter of the volume created by the circular wall can be 1 inch in each of the layers. It can be appreciated that the sizes of the container 100 can vary.

Figure 9:
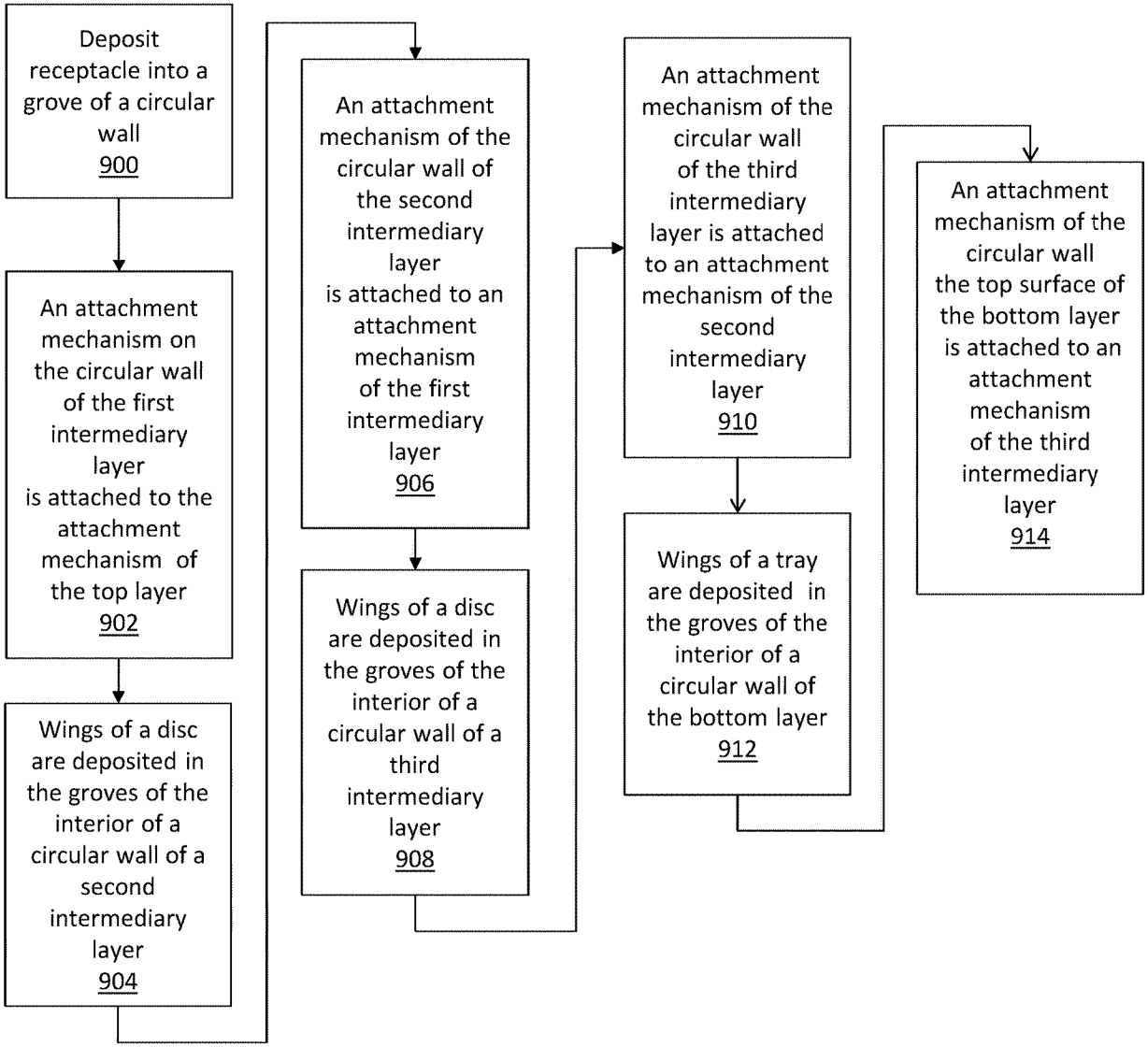
FIG. 9 illustrates the process of the container in accordance with an exemplary embodiment.

FIG. 9 illustrates the process of the ovoid-shaped container transitioning from an open position to a closed position according to example embodiments. In operation 900, a receptacle can be deposited into a groove(s) of a circular wall extending from a top surface of a first intermediary layer of a container made up of a top layer, first, second and third intermediary layers, and a bottom layer. In operation 902, an attachment mechanism disposed around the circular wall extending from the top surface of the first intermediary layer is attached to the attachment mechanism within an interior cavity of the top layer. In operation 904, wings extending from an outside surface of a disc are deposited in the groove(s) of the interior of a circular wall of a second intermediary layer. In operation 906, an attachment mechanism disposed around the circular wall extending from the top surface of the second intermediary layer is attached to an attachment mechanism disposed around an interior wall of a cavity on a bottom surface of the first intermediary layer. In operation 908, wings extending from an outside surface of a disc are deposited in the groove(s) of the interior of a circular wall of a third intermediary layer. In operation 910, an attachment mechanism disposed around the circular wall extending from the top surface of the third intermediary layer is attached to an attachment mechanism disposed around an interior wall of a cavity on a bottom surface of the second intermediary layer. In operation 912, wings extending from a lip of a tray are deposited in the groove(s) of the interior of a circular wall of the bottom layer. In operation 914, an attachment mechanism disposed around the circular wall extending from the top surface of the bottom layer is attached to an attachment mechanism disposed around an interior wall of a cavity on a bottom surface of the third intermediary layer.

In describing exemplary embodiments, specific terminology is used for the sake of clarity. For purposes of description, each specific term is intended to at least include all technical and functional equivalents that operate in a similar manner to accomplish a similar purpose. Additionally, in some instances where a particular exemplary embodiment includes a plurality of system elements, device components or method steps, those elements, components or steps may be replaced with a single element, component or step. Likewise, a single element, component or step may be replaced with a plurality of elements, components or steps that serve the same purpose. Moreover, while exemplary embodiments have been shown and described with references to particular embodiments thereof, those of ordinary skill in the art will understand that various substitutions and alterations in form and detail may be made therein without departing from the scope of the invention. Further still, other embodiments, functions and advantages are also within the scope of the invention.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than the order shown in the illustrative flowcharts.

I claim:

1. A container comprising:

a top layer including a rounded top surface, a circular flat bottom surface, an interior cavity, wherein the interior cavity is enclosed by a circular wall and attachment mechanisms are disposed on the interior of the circular wall;

a plurality of intermediary layers, each intermediary layer including a circular top surface and a circular bottom surface, wherein the circular top surface includes a circular wall extending from the circular top surface creating a volume with an open face, and the bottom surface including a circular interior cavity, the outside of the circular wall and the interior of the circular interior cavity including attachment mechanisms, a bottom layer including a top surface and a bottom surface, wherein the top surface includes a circular wall extending from the top surface creating a volume with an open face, the outside of the circular wall of the bottom layer including attachment mechanisms, the bottom surface includes a flat base, wherein the top layer and the bottom layer are each secured to at least one intermediary layer using the attachment mechanisms to form an ovoid shaped container.

2. The container of claim 1, wherein grooves are disposed around the interior of the circular wall of each of the intermediary and bottom layers.

3. The container of claim 2, further comprising a circular receptacle configured to store and support liquid or solid objects, the circular receptacle is disposed within the volume of an intermediary layer and secured in the grooves of a circular wall of the intermediary layer disposed directly below the top layer.

4. The container of claim 3, further comprising a plurality of circular discs configured to store and support liquid or solid objects, each of the circular discs disposed within the volume of at least one of the intermediary layers and are secured in the grooves of a circular wall of the at least one of the intermediary layers.

5. The container of claim 4, wherein each of the plurality of circular discs include an outside surface and an interior volume, wings extend from the outside surface and are configured to rest in the grooves of the circular wall of the at least one of the intermediary layers.

6. The container of claim 5, further comprising a circular tray configured to store and support liquid or solid objects, the circular tray is disposed within the volume of the bottom layer and secured in the grooves of the circular wall of the bottom layer.

7. The container of claim 6, wherein the tray includes an outside surface and an interior volume, wings extend from the outside surface and are configured to rest in the grooves of the circular wall of the bottom layer.

8. The container of claim 7, wherein in response to the top, intermediary and bottom layers being attached to one another, the container is in a closed position.

9. The container of claim 8, wherein the receptacle, the plurality of discs and the tray are inaccessible when the container is in the closed position.

10. The container of claim 7, wherein in response to the top, intermediary and/or bottom layers being detached from one another, the container is in an open position.

11. The container of claim 10, wherein the receptacle, the plurality of discs and/or the tray are accessible when the container is in an open position.

12. The container of claim 1, wherein the attachment mechanisms disposed on the outside of a circular wall of a first intermediary layer of the plurality of the intermediary layers are configured to be attached to the attachment mechanisms disposed on the interior of the circular wall of the top layer.

13. The container of claim 12, wherein the attachment mechanisms disposed on the outside of a circular wall of a second intermediary layer of the plurality of intermediary layers are configured to be attached to the attachment mechanisms disposed in the interior of the circular interior cavity of the circular bottom surface of the first intermediary layer.

14. The container of claim 13, wherein the attachment mechanisms disposed on the outside of a circular wall of a third intermediary layer of the plurality of intermediary layers are configured to be attached to the attachment mechanisms disposed in the circular interior cavity of the circular bottom surface of the second intermediary layer.

15. The container of claim 14, the attachment mechanisms disposed on the outside of a circular wall of bottom layer are configured to be attached to the attachment mechanisms disposed in the circular interior cavity of the bottom surface of the third intermediary layer.

16. The container of claim 1, wherein the attachment mechanisms of the top, intermediary and bottom layers are threaded.

17. A container assembly comprising:

a top layer including a rounded top surface, a circular flat bottom surface, an interior cavity, wherein the interior cavity is enclosed by a circular wall and attachment mechanisms are disposed on the interior of the circular wall;

a plurality of intermediary layers, each intermediary layer including a circular top surface and a circular bottom surface, wherein the circular top surface includes a circular wall extending from the circular top surface, creating a volume with an open face, and the bottom surface includes a circular interior cavity, the outside of the circular wall and the interior of the circular interior cavity including attachment mechanisms, a bottom layer including a top surface and a bottom surface, wherein the top surface includes a circular wall extending from the top surface, creating a volume with an open face, the outside of the circular wall of the bottom layer including attachment mechanisms, the bottom surface includes a flat base, wherein in an assembled state, the attachment mechanisms disposed on the outside of a circular wall of a first intermediary layer of the plurality of the intermediary layers are configured to be attached to the attachment mechanisms disposed on the interior of the circular wall of the top layer, the attachment mechanisms disposed on the outside of a circular wall of a second intermediary layer of the plurality of intermediary layers are configured to be attached to the attachment mechanisms disposed in the interior of the circular interior cavity of the circular bottom surface of the first intermediary layer, the attachment mechanisms disposed on the outside of a circular wall of a third intermediary layer of the plurality of intermediary layers are configured to be attached to the attachment mechanisms disposed in the circular interior cavity of the circular bottom surface of the second intermediary layer, the attachment mechanisms disposed on the outside of a circular wall of bottom layer are configured to be attached to the attachment mechanisms disposed in the circular interior cavity of the bottom surface of the third intermediary layer.

18. A container comprising:

a top layer including a rounded top surface, a circular flat bottom surface, an interior cavity, wherein the interior cavity is enclosed by a circular wall and attachment mechanisms are disposed on the interior of the circular wall;

a plurality of intermediary layers, each intermediary layer including a circular top surface and a circular bottom surface, wherein the circular top surface includes a circular wall extending from the circular top surface, creating a volume with an open face, and the bottom surface includes a circular interior cavity, the outside of the circular wall and the interior of the circular interior cavity including attachment mechanisms, and the interior of the circular wall including grooves, a bottom layer including a top surface and a bottom surface, wherein the top surface includes a circular wall extending from the top surface, creating a volume with an open face, the outside of the circular wall of the bottom layer including attachment mechanisms, the interior of the circular wall including grooves, the bottom surface including a flat base, a circular receptacle configured to store and support liquid or solid objects, the circular receptacle is disposed within the volume of an intermediary layer and secured in the grooves of a circular wall of the intermediary layer disposed directly below the top layer;

a plurality of circular discs configured to store and support liquid or solid objects, each of the circular discs disposed within the volume of at least one of the intermediary layers and are secured in the grooves of a circular wall of the at least one of the intermediary layers, wherein each of the plurality of circular discs include an outside surface and an interior volume, wings extend from the outside surface and are configured to rest in the grooves of the circular wall of the at least one of the intermediary layers, and a circular tray configured to store and support liquid or solid objects, the circular tray is disposed within the volume of the bottom layer and secured in the grooves of the circular wall of the bottom layer, wherein the tray includes an outside surface and an interior volume, wings extend from the outside surface and are configured to rest in the grooves of the circular wall of the bottom layer.

19. The container in claim 18, wherein the flat base is configured to support the container and maintain the container in an upright position.

20. The container in claim 18, wherein the attachment mechanisms are one or more of: grooves, screws, magnetic devices, adhesive material, fastening material, hooks, and loop fasteners.

* * * * *